US009752419B2

(12) United States Patent
Martin et al.

(10) Patent No.: US 9,752,419 B2
(45) Date of Patent: Sep. 5, 2017

(54) MORPHING TUBULARS

(71) Applicant: SCHLUMBERGER TECHNOLOGY CORPORATION, Sugar Land, TX (US)

(72) Inventors: David Glen Martin, Keith (GB); Neil Thomson, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/866,988

(22) Filed: Sep. 27, 2015

(65) Prior Publication Data

US 2016/0097262 A1 Apr. 7, 2016

(30) Foreign Application Priority Data

Oct. 3, 2014 (GB) ..... 1417557.4

(51) Int. Cl.
*E21B 43/10* (2006.01)

(52) U.S. Cl.
CPC ..... *E21B 43/105* (2013.01); *E21B 43/103* (2013.01); *E21B 43/108* (2013.01)

(58) Field of Classification Search
CPC ..... E21B 33/127; E21B 43/108; E21B 23/01; E21B 43/105; E21B 33/128; E21B 33/1212; E21B 33/1295
See application file for complete search history.

(56) References Cited

U.S. PATENT DOCUMENTS

| | | | | |
|---|---|---|---|---|
| 7,055,607 | B2 * | 6/2006 | Jacob | E21B 33/10 166/126 |
| 7,306,033 | B2 | 12/2007 | Gorrara et al. | |
| 2003/0000875 | A1 * | 1/2003 | Echols | E21B 19/22 210/85 |
| 2005/0178559 | A1 * | 8/2005 | Jacob | E21B 33/10 166/374 |
| 2015/0315864 | A1 * | 11/2015 | Patton | E21B 43/103 166/382 |

(Continued)

FOREIGN PATENT DOCUMENTS

| | | | |
|---|---|---|---|
| GB | 2398312 | A | 8/2004 |
| GB | 2425803 | A | 11/2006 |

(Continued)

OTHER PUBLICATIONS

International Search Report and Written Opinion for corresponding PCT Application Serial No. PCT/GB2015/052867 dated Feb. 15, 2016, 12 pages.

(Continued)

*Primary Examiner* — James G Sayre

(57) ABSTRACT

A hydraulic fluid delivery tool for morphing a tubular downhole and a method of morphing a tubular downhole. The tool has spaced apart annular elastomer seal assemblies which operate by application of a piston against each elastomer to create a seal against the tubular. A first hydraulic fluid delivery line delivers fluid at a first pressure to operate the pistons. A second hydraulic fluid delivery line delivers fluid at a second pressure, lower than the first, to a location between the seals to morph the tubular and act on a second face of each piston to assist in maintaining the seal.

15 Claims, 2 Drawing Sheets

(56) References Cited

U.S. PATENT DOCUMENTS

| | | | | |
|---|---|---|---|---|
| 2015/0345249 | A1* | 12/2015 | Gorrara | E21B 33/127 166/387 |
| 2016/0047178 | A1* | 2/2016 | Thomson | E21B 17/04 166/380 |
| 2016/0097254 | A1* | 4/2016 | Wood | E21B 33/1277 166/387 |
| 2016/0097262 | A1* | 4/2016 | Martin | E21B 43/103 166/384 |
| 2016/0097263 | A1* | 4/2016 | Thomson | E21B 23/04 166/384 |
| 2016/0102522 | A1* | 4/2016 | Martin | E21B 33/1212 166/387 |
| 2016/0194931 | A1* | 7/2016 | Meikle | E21B 33/127 166/387 |
| 2016/0273305 | A1* | 9/2016 | Murphree | E21B 34/063 |

FOREIGN PATENT DOCUMENTS

| | | | | |
|---|---|---|---|---|
| GB | 2511503 | A | 9/2014 | |
| GB | WO 2015166257 | A3 * | 12/2015 | E21B 43/103 |
| GB | WO 2015177545 | A3 * | 3/2016 | E21B 33/126 |
| WO | 00/37769 | A1 | 6/2000 | |
| WO | 2007/119052 | A1 | 10/2007 | |
| WO | 2012/127229 | A2 | 9/2012 | |

OTHER PUBLICATIONS

GB Combined Search and Examination Report for corresponding GB Application Serial No. 1517258.8 dated Jan. 13, 2016, 5 pages.

* cited by examiner

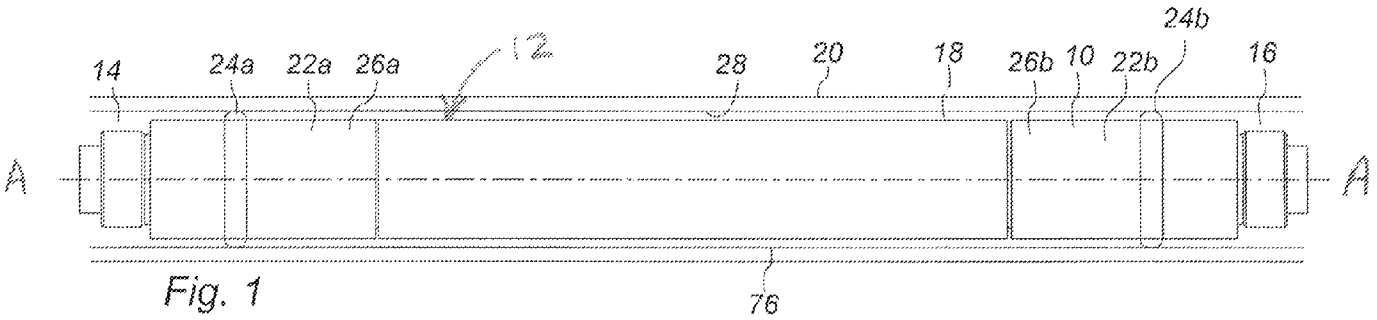
Fig. 1
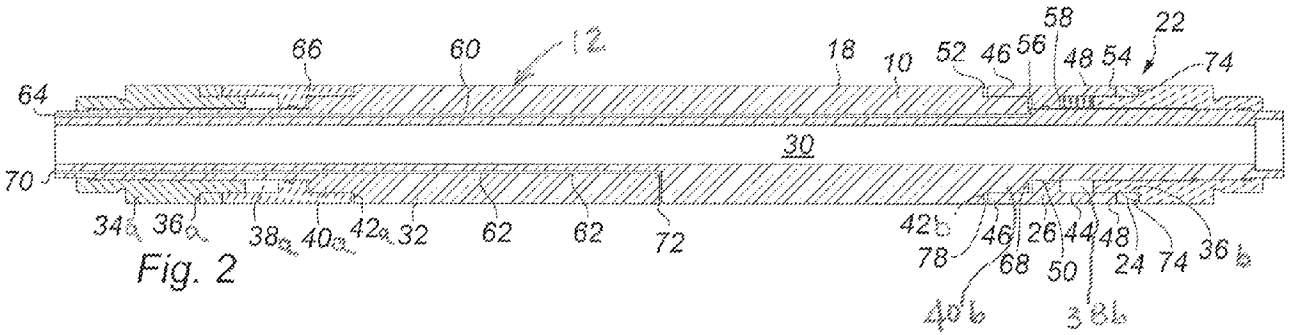
Fig. 2
Fig. 3

MORPHING TUBULARS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to an apparatus and method, particularly but not exclusively, for assisting in deploying and/or securing a tubular section referred to as a "tubular member" within a liner or borehole.

Oil or gas wells are conventionally drilled with a drill string at which point the open hole is not lined, hereinafter referred to as a "borehole". After drilling, the oil, water or gas well is typically completed thereafter with a casing or liner and a production tubing, all of which from here on are referred to as a "tubular".

Conventionally, during the drilling, production or workover phase of an oil, water or gas well, there may be a requirement to provide a patch or temporary casing across an interval, such as a damaged section of liner, or an open hole section of the borehole. Additionally, there may be a requirement to cut a tubular (such as a section of casing) downhole, remove the upper free part and replace it with a new upper length of tubular in an operation know as "tie back" or 'casing reconnect' and in such a situation it is important to obtain a solid metal to metal seal between the lower "old" tubular section and upper "new" tubular section. Further, there may be a requirement to create an isolation barrier between two zones in an annular space in a well.

The present applicants have developed a technology where a tubular metal portion is forced radially outwardly by the use of fluid pressure acting directly on the portion. Sufficient hydraulic fluid pressure is applied to move the tubular metal portion radially outwards and cause the tubular metal portion to morph itself onto a generally cylindrical structure in which it is located. The portion undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed tubular metal portion. During the morphing (hydroforming) process, both the inner and outer surfaces of the tubular metal portion will take up the shape of the surface of the wall of the cylindrical structure. This morphed tubular is therefore ideally suited for creating a seal between a liner and previously set casing or liner which is worn and presents an irregular internal surface. The morphed tubular metal portion may also be a sleeve if mounted around a supporting tubular body, being sealed at each end of the sleeve to create a chamber between the inner surface of the sleeve and the outer surface of the body. A port is arranged through the body so that fluid can be pumped into the chamber from the throughbore of the body. This morphed isolation barrier is ideally suited for creating a seal between a tubular string and an open borehole.

WO2007/119052 and WO2012/127229, both to the present Applicants, show assemblies based on morphing one tubular within another. A morphed isolation barrier is disclosed in U.S. Pat. No. 7,306,033, which is incorporated herein by reference.

In order to morph the tubular metal section in a wellbore, fluid at a high pressure must be delivered to the location. It will be appreciated that the location may be thousands of feet in depth and thus pumping fluid from the surface will have drawbacks in that, the fluid pressure will reduce with depth and cannot be adequately calculated to ensure sufficient morphing pressure is reached. Additionally, it may not be desirable to pump such high fluid pressure through the tubing string for many well designs.

To overcome this, the present applicants have proposed a hydraulic fluid delivery tool or morph tool which can be run into the string from surface by means of coiled tubing or other suitable method. The tool is provided with upper and lower seals, which are operable to radially expand and seal against the inner surface of the string at a pair of spaced apart locations in order to isolate an internal portion of the string between the seals at the desired location. Fluid at high pressure can then be delivered to the location via a port in fluid communication with the interior of the string. For deep water projects a pressure intensifier is typically coupled to the hydraulic fluid delivery tool to increase the fluid pressure for morphing.

The upper and lower seals operate like the elastomeric or rubber seals found on packers. The use of radially expandable packers is well known in the art. Generally, there are two types of packers, the first type is inflatable rubber packers and the second type is compact rubber packers. These packers typically operate by requiring a control line to surface by which hydraulic fluid is either injected into the inflatable rubber packer to cause its expansion; or used against a wedge element so that the annular compact rubber seal expands by being forced up the wedge. A disadvantage of these arrangements is in maintaining sufficient pressure to keep the seal and prevent leakage.

In order to create radial expansion of the seals, the present Applicants have developed a sealing device described in GB 2425803. The sealing device comprises:—at least one substantially cylindrical inner element; at least one seal assembly; and a displacement means operable to apply a force on the said seal assembly; where the said inner element comprises a wedge member, and the said seal assembly is slidable over the wedge member along the longitudinal direction of the inner element, wherein the said seal assembly expands radially outward when forced over the wedge member; the seal assembly comprising a radially expandable annular seal supported by at least one radially expandable support sleeve; characterised in that the support sleeve forms a substantially continuous support surface towards the said annular seal in both expanded and non-expanded positions.

This is a complex construction with interleaved fingers to achieve the continuous support sleeve. When provided as a morph tool a further disadvantage of this construction is in the possibility that the fingers and wedges fail to release when the morph is complete and the tool needs to be removed.

It is an object of the present invention to provide a hydraulic fluid delivery tool for morphing tubulars downhole which obviates or mitigates at least some of the disadvantages of the prior art.

BRIEF SUMMARY OF THE INVENTION

According to a first aspect of the invention there is provided a hydraulic fluid delivery tool for morphing a tubular downhole, the hydraulic fluid delivery tool comprising:

a substantially cylindrical body having an inner bore therethrough;

first and second seal assemblies arranged upon the cylindrical body at a pair of spaced apart locations in order to isolate an internal portion of a tubular between the seal assemblies at a desired location;

each seal assembly comprising an annular elastomer and an annular piston, the piston arranged to compress the elastomer to create a seal between the cylindrical body and the tubular;

a first fluid delivery line through a wall of the cylindrical body, the first fluid delivery line having at least one first input at a first end of the cylindrical body and at least two first outputs to deliver fluid at a first pressure to a first face of each piston so as to move the piston against the elastomer at each seal assembly;

a second fluid delivery line through a wall of the cylindrical body, the second fluid delivery line having at least one second input at a first end of the cylindrical body and at least one second output to an outer surface of the cylindrical body at the desired location to deliver fluid at a second pressure to perform a morph at the location; and wherein the first pressure is greater than the second pressure and each piston includes a second face, the second face being exposed to the internal portion during compression of the elastomer so that fluid at the second pressure acts on the second face and assists in maintaining the seal.

In this way, compression seals are used for morphing and the pressure used to create the morph is advantageously used to maintain the seal during the morph i.e. pressure is held on the elastomers from the inside. This is in contrast to packers where the pressure to make the seal is applied from the outside.

Preferably, each piston is located within a recess on the cylindrical body, each piston having an outer diameter being less than or equal to an outer diameter of the cylindrical body. Preferably also, each piston moves laterally within the recess. In this way, there is no change in metal outer diameter during operation, which prevents the tool from getting stuck in a wellbore and allows the tool to rotate without risk of damage.

Preferably, each elastomer is located within the recess on the cylindrical body, each elastomer having an initial outer diameter being less than or substantially equal to an outer diameter of the cylindrical body. In this way, the elastomer will be protected from damage during run-in and pulling out of the well.

Preferably, each elastomer has a back-up seal arranged on or around a portion of the elastomer. In this way, the elastomer is prevented from extruding from the recess.

Preferably, each piston includes a third face, the third face being opposite the first face, and including a spring arranged to act upon the third face to return the piston to an initial position when the first pressure is bled-down. In this way, the pistons and elastomers retract for release without requiring a further operating function.

Preferably, the hydraulic fluid delivery tool includes a pressure intensifier. In this way, high pressure fluid is delivered to the inputs at the first end of the cylindrical body regardless of the location in the wellbore.

Additionally, a pressure distribution tool may be located between the hydraulic fluid delivery tool and the pressure intensifier. The pressure distribution tool may take in high pressure fluid from the pressure intensifier and provide a first output to deliver fluid at the first pressure and a second output to deliver fluid the second pressure. In this way, a single input of high pressure fluid can be split and used to operate the pistons and morph the tubular.

According to a second aspect of the present invention there is a method of morphing a tubular downhole, comprising the steps:

(a) connecting a hydraulic fluid delivery tool, according to the first aspect, on a string;

(b) positioning the hydraulic fluid delivery tool at a location in the tubular;

(c) delivering fluid at a first pressure to a first face of each piston so as to move the piston against the elastomer at each seal assembly;

(d) creating a pair of seals between the cylindrical body and the tubular;

(e) isolating an internal portion of the tubular between the seal assemblies at a desired location;

(f) delivering fluid at a second pressure to an outer surface of the cylindrical body at the desired location;

(g) morphing the tubular; and (h) delivering the fluid at the second pressure to the second face of each piston to maintain the seal.

In this way, the pressure used to create the morph is advantageously used to maintain the seal during the morph i.e. pressure is held on the elastomers in a direction towards each end of the tool. This is in contrast to packers where the pressure to make the seal is applied in a direction from the ends towards the centre of the packer.

Preferably, the method includes the step of moving the pistons laterally outwards from the location. In this way, the morph pressure is used to assist in maintaining the seal.

Preferably, the elastomers are compressed to form the seals prior to the second pressure being delivered to the location. In this way, the second pressure can be lower than the first pressure to ensure a seal is formed and a morph can be achieved at lower pressures.

Preferably, the method includes the step of bleeding down the first pressure. In this way, the elastomers will automatically retract after morphing is complete, for easy removal of the tool.

In an embodiment, the method includes the step of morphing the tubular between the upper and lower seals. In this way, the method is suitable for internal clads, liner tiebacks, casing reconnects and liner hangers. Alternatively, the method includes the step of delivering the fluid at the second pressure through a port in the tubular so as to enter a chamber formed by a further tubular arranged as a sleeve on the tubular, and morphing the further tubular. In this way, the method is suitable for isolation barriers.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

BRIEF DESCRIPTION OF THE SEVERAL VIEWS OF THE DRAWING(S)

Embodiments of the present invention will now be described, by way of example only, with reference to the accompanying drawings in which:

FIG. 1 is a schematic illustration of a hydraulic fluid delivery tool according to an embodiment of the present invention;

FIG. 2 is a cross section of a side view of the hydraulic fluid delivery tool of FIG. 1 in a first state according to an embodiment of the present invention;

FIG. 3 is a cross section of a side view of the hydraulic fluid delivery tool of FIG. 1 in a second state according to an embodiment of the present invention.

DETAILED DESCRIPTION OF THE INVENTION

Figure 4:
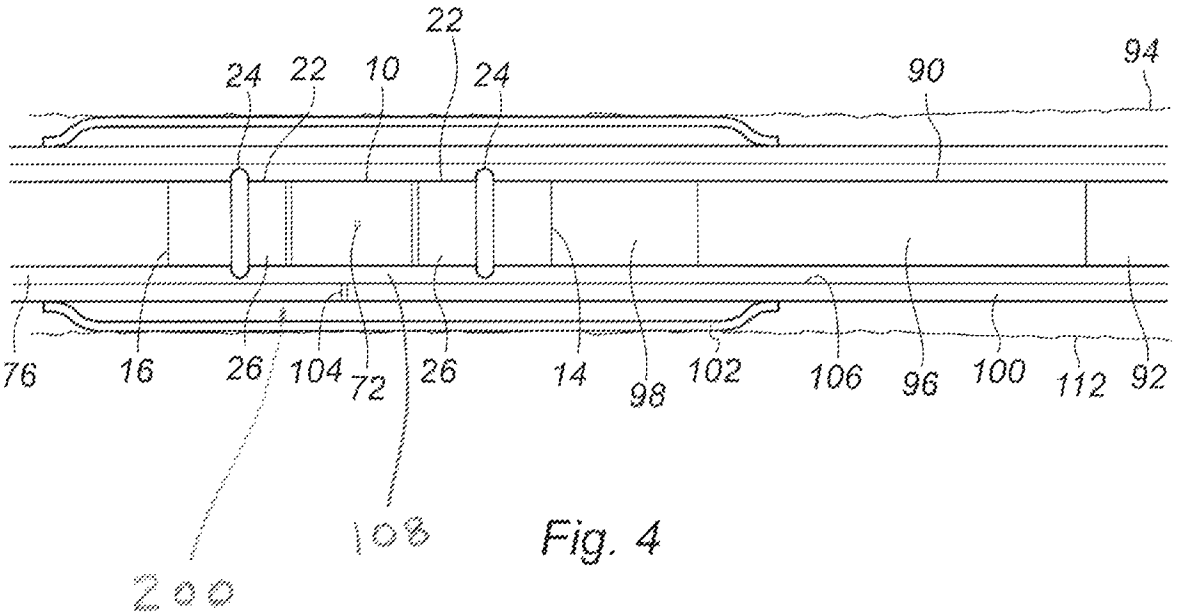
FIG. 4 is a schematic illustration of an assembly including a hydraulic fluid delivery tool morphing a tubular in a wellbore according to an embodiment of the present invention.

Referring initially to FIG. 1 there is provided a hydraulic fluid delivery tool, generally indicated by reference numeral 10, for morphing a tubular 20 according to an embodiment of the present invention.

The hydraulic fluid delivery tool 10 comprises a cylindrical body 12 provided with a first end 14, a second end 16 and outer cylindrical surface 18. Towards each end 14,16 is provided seal assemblies 22*a,b* including an annular elastomer 24*a,b* and an annular piston rings 26*a,b* arranged to provide a seal against an inner surface 28 of the tubular 20.

The ends 14, 16 are provided with suitable fittings as are known in the art for connecting the tool 10 into a string (not shown) for running the tool 10 into a wellbore. Suitable strings may be coiled, tubing, drill pipe, liner and the like.

Tool 10 is shown in further detail in FIG. 2 in cross section along longitudinal axis A of FIG. 1.

Cylindrical body 12 is of metal construction and is a substantially hollow tubular with a bore 30 defined therethrough. The bore 30 is independent of the seal assemblies 22*a,b* and allows for the passage of fluid or other strings through the tool 10 when in the wellbore. The body 12 is of three part construction providing a central section 32 and end pieces 34*a,b* which are fitted over the central section 32 at each end 14,16. The end pieces 34*a,b* hold the seal assemblies 22*a,b* in place and provide a side wall 36*a,b* to a recess 38*a,b* in the cylindrical body 12 at each seal assembly 22*a,b*. The end pieces 34 may be of a different metal than the central section 32.

A recess 38*a,b* is formed towards each end 14,16 of the tool via a stepped section 40*a,b* on the central section 32 and the opposing stepped side wall 36*a,b* of the end piece 34*a,b*. The stepped section 40*a,b* provides a side wall 42*a,b*. The seal assemblies 22*a,b* are arranged at each recess 38*a,b*. The arrangements of the seal assemblies 22*a,b* and recesses 38*a,b* are the same at each end 14,16 but are mirror images or reversed and as such, we will describe one of the seal assembly 22 arrangements.

The seal assembly 22 comprises an annular piston ring 26 and a deformable seal ring or elastomer band 24. The piston ring 26 has an outer band 44 which forms two projections 46,48 extending along the longitudinal axis from a central projection 50 which projects radially inwards. The piston ring 26 is mounted in the cylindrical stepped recess 38 formed between the walls 36,42 of the body 12. The piston ring 26 has four annular faces, each face being perpendicular to the longitudinal axis. There is a face 52,54 on each projection 46,48 and also on either side 56,58 of the central projection 50. With the piston ring 26 in the recess 38, the faces conform to the stepped profile of the side walls 36,42, but the length of the piston ring 26 is shorter than the length of the recess 38. When located in the recess 38, the piston ring 26 has an outer diameter which is the same as the outer diameter of the cylindrical body 12 to present a near continuous outer surface 18 to the tool 10. An o-ring seal is located around the circumference of the inner surface of the piston ring 26 to provide a seal against the base of the recess 38. The piston ring 26 can move laterally on the body 12 within the recess 38, travelling co-axially to the bore 30 along the longitudinal axis (marked as section line A-A in FIG. 1).

Located in the recess 38, between the piston face 54 of projection 48 and the outer section of side wall 36 is the annular elastomer band 24. The annular elastomer 24 is designed to fit against the surface of the step in the recess 38 and have an outer diameter less than or equal to the outer diameter of the body 12. This prevents damage to the elastomer 24 during run-in. The elastomer 24 may be of any material which, under compression, will uniformly change its shape and provide a seal against the inner surface 28 of the tubular 20. As the elastomer is only required for single use i.e. it only has to maintain a seal for the duration of a morph, materials which harden, decompose or perish with time or exposure to well fluids can be used. This is in contrast to the elastomers used in compression set packers which must hold the seal for potentially the life-time of the well. Additionally the elastomers can have back-up seals.

There are also two fluid delivery conduits 60,62 arranged through the wall of the body 12. A first conduit 60 provides a passage from an input 64 on the face at the first end 14 of the body 12 to output ports 66*a,b* positioned in each recess 38*a,b* at a location on the base of the recess 38 between the face 56 of the projection 50 of the piston ring 26 and an opposing face 68 on the side wall 42. The second conduit 62 provides a passage from an input 70 on the face at the first end 14 of the body 12 to an output port 72 positioned on the outer surface 18 of the body 12 between the two seal assemblies 22*a,b*.

In use, tool 10 is assembled by taking a central section 32 of the body 12 and sliding the piston rings 26 over each end 14,16 with the faces 56,68 together. The elastomer bands 24 are then passed over the ends 14,16. The end pieces 34 are then located over each end 14,16 and arranged under the elastomer 24 and the projection 48 of the piston ring 26. In this arrangement, referred to as a first state, and shown in FIG. 2, the elastomer 24 is in a relaxed position bound by the face 54 of the projection 48 and the face 68 of the side wall 42. The elastomer 24, piston ring 26 and body 12 provide a near continuous outer surface 18. In the first state, the tool 10 is run into a wellbore and located in a tubular 20 at a location where a morph is required.

When in position, fluid is supplied to the input 64 and travels down the first conduit 60. The fluid exits at outputs 66 into a chamber created in the recess 38 between the faces 56,68. As face 68 is fixed, fluid pressure acts on face 54 of the piston ring 26 and causes the piston ring 26 to move laterally along the body 12. This action causes the face 54 to act upon the elastomer 24 thereby causing the elastomer 24 to be compressed against the fixed face 74 of the side wall 36. As the elastomer 24 is compressed, its shape changes as it extends out into the annular space 76 between the body 12 and the tubular 20. Continuing pressure will result in the elastomer 24 bridging the annular space 76 and contacting the inner surface 28 of the tubular 28. This contact forms a fluid tight seal and thus isolates the annular space 76 between the seal assemblies, as can be seen in FIG. 1.

Keeping pressure through the conduit 60 will maintain the seals during morphing. The seals are compression seals and, as the faces are perpendicular to the longitudinal axis, there is no wedge action or radially expansion of the seals. During compression only the outer diameter of the elastomer 24 increases, the outer diameter of the metal parts 12,32,34 does not change. Of note is the fact that the piston rings 26 move towards the ends 14,16 respectively. This is in contrast to the direction of the compressive force used in packers were the pistons or wedges are more typically move from the ends towards the centre of the packer tool.

With the space 76 now isolated, fluid is delivered through the second conduit 70. The fluid is input 70 at the first end 14 and output 72 at a port on the outer surface 18 of the central portion 32 of the body 12. The fluid is referred to as morph fluid as it fills the isolated space 76 and forces the tubular 20 to elastically deform under the fluid pressure between the seals 24. The tubular 20 is expanded radially outwards and will morph against whichever structure it is within e.g. another tubular or open borehole.

As the morph fluid is pumped into the annular space 76, it is noted that the face 52, on the projection 46 of piston ring 26, and the face 78, on the side wall 42 of the body 12, are moved apart as the piston ring 26 has moved. This provides a gap 80 into which the morph fluid can enter. The morph fluid can thus act upon the face 52 of the piston ring 26 to also move the piston ring 26 towards the ends 14,16 and compress the elastomer 24. In this way, the fluid creating the morph is also used to assist in maintaining the seal. This second state is illustrated in FIG. 3.

Once the morph has been completed, the tool 10 can be released by simply bleeding down the fluid pressure in the first conduit 60. By bleeding off the fluid pressure in the conduits, the force on the piston rings 26 is released and the elastomers 24 will relax. As they relax, the piston rings 26 are returned to the position of the first state, illustrated in FIG. 2. A spring 82 located between the face 58 on the projection 50 of the piston ring 26 and the opposing face 84 on the side wall 36 of the end piece 34, can be used to assist in returning the piston ring 26 to the first state. On release all movement is lateral and the outer diameter of the metal parts remains the same. The tool 10 can then be POOH easily.

Reference is now made to FIG. 4 of the drawings which illustrates an assembly, generally indicated by reference numeral 90, according to a further embodiment of the present invention. Assembly 90 is mounted on a string 92 and run in a wellbore 94. Assembly 90 includes the hydraulic fluid delivery tool 10 as described hereinbefore with reference to FIGS. 1 to 3. Mounted above the tool 10, in the assembly 90, is a pressure intensifier 96 and a pressure distribution tool 98.

Pressure intensifiers are known and operate by increasing fluid pressure at a location in the wellbore. The pressure distribution tool 98 takes in high pressure fluid from the pressure intensifier 96 and provides a first output to deliver fluid at the first pressure for input 64 of the tool 10 and a second output to deliver fluid a second pressure for input 70 on the tool 10. Typically, the second pressure is less than the first as the second pressure is the controlled pressure required to morph the tubular.

In use, the assembly 90 is mounted on the string 92 and run in a tubular being a casing or liner 100. Mounted on the liner 100 is a further tubular arranged as a sleeve 102. A port 104 is located through the liner 100 to access a chamber 200 between the liner 100 and the sleeve 102. The assembly 90 is run in until the seal assemblies 22 on the tool 10 straddle the port 104. It will be noted that depending on the length of the tool 10, a large tolerance for this positioning can be built in.

With the assembly 90 in position, high pressure fluid is delivered through input 64 to move the piston rings 26 and compress the elastomer bands 24. The bands 24 will cross the annular space 76 and seal against the inner surface 106 of the liner 100. A portion 108 of the annular space 76 is thus isolated. Morph fluid under pressure from the distribution tool 98 is delivered through input 70 and exits at the surface 18 of the tool 10 into the isolated portion 108. As described hereinbefore, this morph fluid also acts on the piston rings 26 via the isolated portion to assist in maintaining the seal at the elastomers 24.

The morph fluid will travel through the port 104 and act against the inside surface of the sleeve 102 to morph the sleeve 102 against the borehole wall 112. The sleeve 102 thus provides an isolation barrier in the well bore. Both the seals and the morph can be confirmed by monitoring fluid circulation in the annuli. This is possible as the bore 30 through the tool 10 and the string 92 can be used.

Once the morph is achieved, the pressure is bled down in the first conduit 60. The release of pressure on the piston rings 26 and the action of the spring 82, will release the compression on the elastomers 24 and allow them to relax back into their original position within the recesses 38. It is noted that this release action does not require another fluid delivery conduit or any other hydraulic or mechanical action. Thus the release is fail safe. Additionally, as the pressure on the seals is from the centre outwards to the ends of the tool and this pressure is controlled, the seals will release easily as compared to the seals of a compression set packer where the well pressure could prevent the seals release.

With the elastomers 24 returned, the assembly 90 can be POOH without risk of sticking as a continuous uniform cylindrical outer surface 28 is presented on the tool 10.

The principle advantage of the present invention is that it provides a hydraulic fluid delivery tool and method of morphing a tubular using the tool which uses the pressure of the morphing fluid to help maintain the seals during the morph.

A further advantage of the present invention is that it provides a hydraulic fluid delivery tool and method of morphing a tubular using the tool in which does not require a retract function and as the metal outer diameter of the tool does not change the tool cannot get stuck in a well if it fails to release.

A further advantage of the present invention is that it provides a hydraulic fluid delivery tool and method of morphing a tubular using the tool in which the tool can be rotated in the wellbore without risk of damage.

It will be appreciated by those skilled in the art that modifications may be made to the invention herein described without departing from the scope thereof. For example, while single input and outputs are described for the fluid delivery conduits, there may be any number of inputs and outputs on each fluid delivery conduit. Equally there may be multiple fluid delivery conduits. The return spring may be a single spring wrapped around the circumference of the body or a number of springs distributed within the annular chamber. The piston and recess may be of any shape and configuration as long as the piston sits within the recess and faces are provided for fluid to act against.

The invention claimed is:

1. A hydraulic fluid delivery tool for morphing a tubular downhole, the hydraulic fluid delivery tool comprising:

a substantially cylindrical body having an inner bore therethrough;

first and second seal assemblies arranged upon the cylindrical body at a pair of spaced apart locations in order to isolate an internal portion of a tubular between the seal assemblies at a desired location;

each seal assembly comprising an annular elastomer and an annular piston, the piston arranged to compress the elastomer to create a seal between the cylindrical body and the tubular;

a first fluid delivery line through a wall of the cylindrical body, the first fluid delivery line having at least one first input at a first end of the cylindrical body and at least two first outputs to deliver fluid at a first pressure to a first face of each piston so as to move the piston against the elastomer at each seal assembly;

a second fluid delivery line through a wall of the cylindrical body, the second fluid delivery line having at least one second input at a first end of the cylindrical body and at least one second output to an outer surface of the cylindrical body at the desired location to deliver fluid at a second pressure to perform a morph at the location; and wherein the first pressure is greater than the second pressure and each piston includes a second face, the second face being exposed to the internal portion during compression of the elastomer so that fluid at the second pressure acts on the second face and assists in maintaining the seal.

2. A hydraulic fluid delivery tool according to claim 1 wherein each piston is located within a recess on the cylindrical body, each piston having an outer diameter being less than or equal to an outer diameter of the cylindrical body.

3. A hydraulic fluid delivery tool according to claim 1 wherein each piston moves laterally within the recess.

4. A hydraulic fluid delivery tool according to claim 1 wherein each elastomer is located within the recess on the cylindrical body, each elastomer having an initial outer diameter being less than or substantially equal to an outer diameter of the cylindrical body.

5. A hydraulic fluid delivery tool according to claim 1 wherein each elastomer has a back-up seal arranged on or around a portion of the elastomer.

6. A hydraulic fluid delivery tool according to claim 1 wherein each piston includes a third face, the third face being opposite the first face, and including a spring arranged to act upon the third face to return the piston to an initial position when the first pressure is bled-down.

7. A hydraulic fluid delivery tool according to claim 1 wherein the hydraulic fluid delivery tool includes a pressure intensifier.

8. A hydraulic fluid delivery tool according to claim 7 wherein a pressure distribution tool is located between the hydraulic fluid delivery tool and the pressure intensifier.

9. A hydraulic fluid delivery tool according to claim 8 wherein the pressure distribution tool takes in high pressure fluid from the pressure intensifier and provides a first output to deliver fluid at the first pressure and a second output to deliver fluid the second pressure.

10. A method of morphing a tubular downhole, comprising the steps:

(a) connecting a hydraulic fluid delivery tool, according to any one of claims 1 to 9, on a string;

(b) positioning the hydraulic fluid delivery tool at a location in the tubular;

(c) delivering fluid at a first pressure to a first face of each piston so as to move the piston against the elastomer at each seal assembly;

(d) creating a pair of seals between the cylindrical body and the tubular;

(e) isolating an internal portion of the tubular between the seal assemblies at a desired location;

(f) delivering fluid at a second pressure to an outer surface of the cylindrical body at the desired location;

(g) morphing the tubular; and (h) delivering the fluid at the second pressure to the second face of each piston to maintain the seal.

11. A method according to claim 10 wherein the method includes the step of moving the pistons laterally outwards from the location.

12. A method according to claim 10 wherein the elastomers are compressed to form the seals prior to the second pressure being delivered to the location.

13. A method according to claim 10 wherein the method includes the step of bleeding down the first pressure.

14. A method according to claim 10 wherein the method includes the step of morphing the tubular between the upper and lower seals.

15. A method according to claim 10 wherein the method includes the step of delivering the fluid at the second pressure through a port in the tubular so as to enter a chamber formed by a further tubular arranged as a sleeve on the tubular, and morphing the further tubular.

* * * * *